US010792205B2

(12) United States Patent
Batrice

(10) Patent No.: US 10,792,205 B2
(45) Date of Patent: Oct. 6, 2020

(54) MOTORIZED WHEELCHAIR FOR IMPROVED MOBILITY

(71) Applicant: Joseph Paul Batrice, Lubbock, TX (US)

(72) Inventor: Joseph Paul Batrice, Lubbock, TX (US)

( * ) Notice: Subject to any disclaimer, the term of this patent is extended or adjusted under 35 U.S.C. 154(b) by 33 days.

(21) Appl. No.: 15/473,697

(22) Filed: Mar. 30, 2017

(65) Prior Publication Data

US 2018/0280217 A1 Oct. 4, 2018

(51) Int. Cl.

| | |
|---|---|
| ***A61G 7/10*** | (2006.01) |
| ***A61G 5/12*** | (2006.01) |
| ***A61G 5/10*** | (2006.01) |

(52) U.S. Cl.

CPC ..... *A61G 7/1086* (2013.01); *A61G 5/1059* (2013.01); *A61G 5/12* (2013.01); *A61G 5/127* (2016.11); *A61G 7/1025* (2013.01); *A61G 7/1046* (2013.01); *A61G 7/1096* (2013.01); *A61G 5/1089* (2016.11); *A61G 5/125* (2016.11); *A61G 2200/38* (2013.01)

(58) Field of Classification Search

CPC .. A61G 7/1013; A61G 7/1046; A61G 7/1086; A61G 7/1057; A61G 7/16; A61G 5/14; A61G 5/125; A61G 5/127; A61G 5/10; B62K 5/003; B62K 5/007; B62K 3/002; B62B 1/12; B62B 1/20; B62B 1/30; B62B 9/102; B62B 9/104; B62M 1/00; B62M 1/14; A61H 3/04; A47C 9/005

USPC ..... 135/66, 67; 180/208, 907

See application file for complete search history.

(56) References Cited

U.S. PATENT DOCUMENTS

| | | | | |
|---|---|---|---|---|
| 4,773,494 | A | 9/1988 | Anderson | |
| 5,001,789 | A * | 3/1991 | Schoenberger | A61G 7/1017 5/87.1 |
| 5,093,944 | A * | 3/1992 | Winston, Sr. | A61G 7/1017 280/47.25 |
| 5,096,008 | A | 3/1992 | Mankowski | |
| 5,201,377 | A * | 4/1993 | Wilson | A61G 5/045 180/6.5 |
| 5,233,708 | A * | 8/1993 | Winston, Sr. | A61G 7/1038 280/47.25 |
| 5,340,139 | A * | 8/1994 | Davis | A61G 5/00 280/250.1 |
| 5,489,258 | A * | 2/1996 | Wohnsen | A61G 5/14 280/250.1 |
| 5,600,857 | A * | 2/1997 | Heilmann | A61G 5/00 5/81.1 R |
| 5,730,236 | A | 3/1998 | Miller et al. | |
| 6,231,067 | B1 | 5/2001 | Johnson et al. | |
| 7,055,840 | B1 | 6/2006 | Kelso | |
| 8,128,120 | B2 * | 3/2012 | Porcheron | A61G 5/006 180/65.1 |
| 8,544,866 | B2 | 10/2013 | Noonan et al. | |
| 9,060,911 | B2 | 6/2015 | Hyde et al. | |
| 9,498,398 | B1 * | 11/2016 | Ehrenleitner | A61G 15/02 |
| 2012/0104711 | A1 * | 5/2012 | Alexander | A61G 5/00 280/47.34 |

(Continued)

*Primary Examiner* — Eric J Kurilla
*Assistant Examiner* — Amanda L Bailey
(74) *Attorney, Agent, or Firm* — Cameron P. Smith

(57) ABSTRACT

A wheelchair assembly that enables an occupant to rotate their self from the seating position to the prone or kneeling prone position so that the occupant may use their arms to better reach and grasp without the aid of another person.

17 Claims, 3 Drawing Sheets

(56) References Cited

U.S. PATENT DOCUMENTS

2013/0307298 A1* 11/2013 Meiki ..... A61G 7/015
297/68

* cited by examiner

MOTORIZED WHEELCHAIR FOR IMPROVED MOBILITY

CROSS-REFERENCE TO RELATED APPLICATIONS

None.

STATEMENT OF FEDERALLY SPRONSORED RESEARCH OR DEVELOPMENT

None.

REFERENCE TO A SEQUENCE LISTING, A TABLE, OR A COMPUTER LISTING COMPACT DISC APPENDIX

None.

BACKGROUND OF THE INVENTION

This invention relates to a motorized wheelchair, more specifically a wheelchair to improve the mobility of the occupant.

Wheelchairs and motorized wheelchairs have been around for a number of years. They have allowed persons limited in their ability to ambulate the freedom to move about as well as alter positions.

Prior art of such motorized wheelchairs focuses on the ability of the chair to assist occupants in moving from a sitting to a standing position (see U.S. Pat. No. 6,231,067 to Johnson) as well as moving the occupant vertically up and down while in a seated position (see U.S. Pat. No. 5,730,236 to Miller). Prior art has also touched on moving the occupant of the wheelchair from a sitting to a fully supine position (see U.S. Pat. No. 8,544,866 to Noonan).

While prior art exists for powered and motorized wheelchairs that maneuver and manipulate the occupant to a variety of positions, there is still a need for a wheelchair that moves the occupant into a prone or kneeling prone position. An occupant in the prone or kneeling prone position would be able to reach, grasp, and perform tasks not capable in any other positions. Stress and shear can be caused by this movement. However, by providing the proper support and cushion, the need for occupant manipulation to a prone position can be met.

A wheelchair should also be adjustable so as to be able to accommodate different occupants who are each sized differently. Further, as with most machines, a wheelchair should be simple in design with the minimum number of parts, so as to reduce assembly time and reduce the number of parts that could potentially break down, need maintenance or repair.

Therefore, there exists a need for a wheelchair that reduces shear on the occupant when moving between the seated and prone positions, as well as reduces stress on the lower body of the occupant, improves the reaching capabilities of the occupant while providing lasting comfort to the occupant in the prone position, adjusts so as to accommodate different occupants, and is simple in design with a reduced number of parts and systems. In addition to the above requirements, the wheelchair should be designed so as to be aesthetically appealing.

SUMMARY OF THE INVENTION

This invention satisfies the above needs. A novel wheelchair for the manipulation of the occupant from the seated to the prone or kneeling prone position is provided.

A wheelchair assembly that enables an occupant to rotate their self from the seated position to the kneeling prone position so that the occupant may use their arms to better reach and grasp without the aid of another person. The wheelchair has a mobile base having a frame with front and rear ends as well as a pair of front wheels connected to the front of the frame and a pair of back wheels connected to the back of the frame. It has a seat assembly connected to the back end of the frame and the seat is adjustable at least upward or downward. It has a complete occupant support assembly including at least one leg support and at least one chest support. The occupant support assembly can be configured in a number of ways. One configuration is where the leg support is generally upright and perpendicular to the seat, ground, and chest support. Another configuration is with the leg support rotated forward to where it is more parallel with the seat, ground, and chest support. The wheelchair also has at least one armrest that is capable of adjustment at least up and down vertically. Within the wheelchair is a rotating assembly anchored to the frame that can rotate the leg support between at least the first configuration and the second configuration wherein the occupant is rotated from the seated position into the kneeling prone position. The armrest or armrest assembly may be independently anchored to the frame of the wheelchair or may be anchored to the rotating assembly. When anchored to the rotating assembly, the armrest or armrest assembly may be controlled by an electric motor and may move in conjunction with the rotating assembly.

The armrest may include an upper portion against which an occupant's arm may rest during use of the wheelchair and may provide additional support to the occupant in use when rotating between a first configuration and a second configuration.

The rotating assembly may have an electric motor that assists the occupant in rotating between configurations of the wheelchair. An electric battery may supply the necessary power to run the electric motor.

The electric motor could be controlled by an electric control switch to use the motor to operate the rotating assembly between configurations or clockwise and counter clockwise.

The seat assembly, leg support, and armrest are configurable into multiple configurations that could include a first, seated upright configuration with the occupant seated upright in the seat assembly with the occupant's legs in the leg support generally perpendicular to the ground and the occupant's arms on the armrest. The second configuration would comprise a kneeling prone position with the occupant free of the seat assembly and the occupant's legs in the leg support generally parallel to the ground with the occupant's arms on the armrest.

The wheelchair could contain a lifting assembly that can rotate the leg support between at least the first configuration and the second configuration wherein the occupant is rotated from the sitting position into the kneeling prone position. The lifting assembly can contain a motor lift mechanism.

The wheelchair can contain a motor lift mechanism that contains two angled arms that ultimately connect the motor to the leg support. The two angled arms can be connected and anchored with pins.

The first angled arm is anchored with a moving pin between the electric motor and leg supports, said first angled arm having a front end connected to the electric motor at the front of the wheelchair below the chest support and said first angled arm having a back end connected to second angled arm.

The second angled arm is anchored with a moving pin between the electric motor and leg supports, said second angled arm having a front end connected to the first angled arm and said second angled arm having a back end connected to the leg supports.

The lift mechanism and angled arm may be connected within a guide.

The electric switch would cause the electric motor to move the motor lift mechanism between the multiple configurations.

BRIEF DESCRIPTION OF THE DRAWINGS

These and other features, aspects, and advantages of the present invention will become better understood with regard to the following descriptions, appended claims, and accompanying drawings where:

DETAILED DESCRIPTION OF THE INVENTION

In the Summary of the Invention above and in the Detailed Description of the Invention, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also one or more other components.

Where reference if made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm, and whose upper limit is 100 mm.

Figure 1:
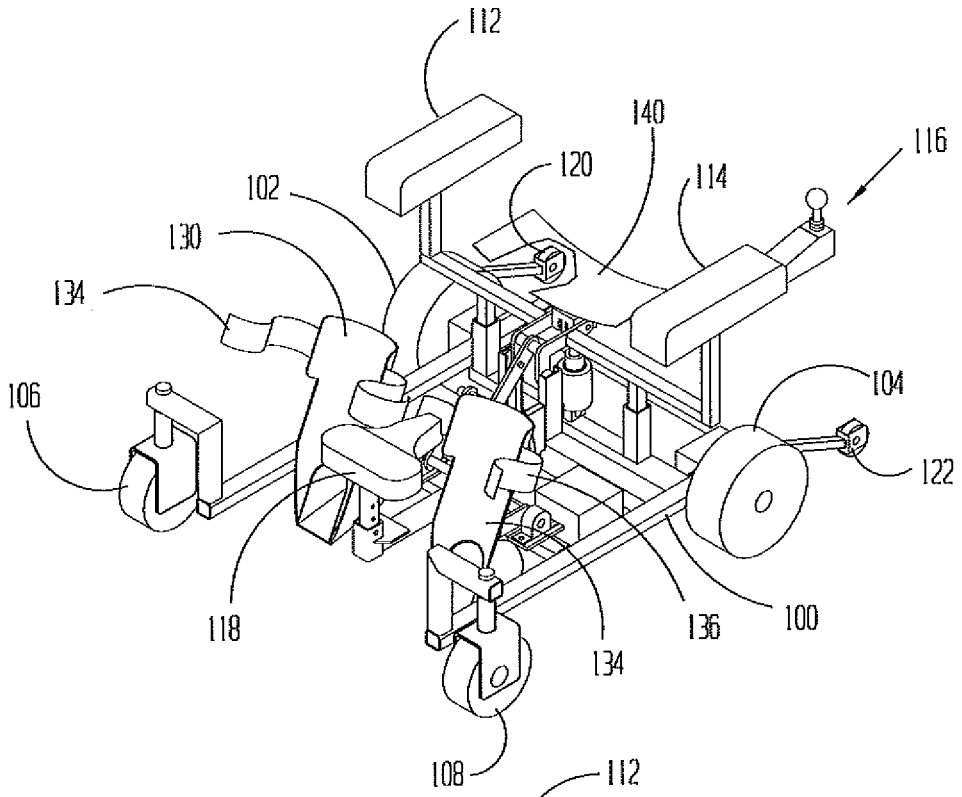
FIG. 1 is a perspective view of one configuration of the wheelchair assembly with the occupant in the seated or standing position.
Figure 2:
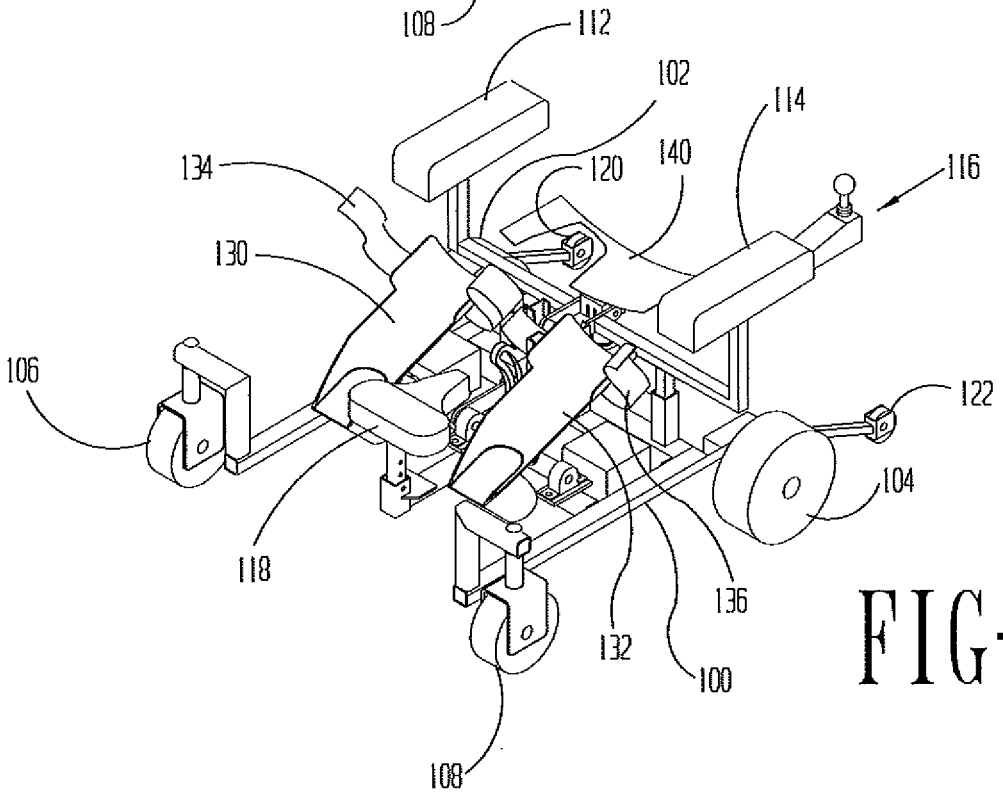
FIG. 2 is a perspective view of one configuration of the wheelchair assembly with the occupant in the kneeling prone position.

As shown in FIG. 1 and FIG. 2, one embodiment of the claimed wheelchair assembly comprises a mobile base having a frame 100, front wheels 102 104, back wheels 106 108, and safety support wheels 120 122. The frame 100 can be made of a material such as metal or plastic.

The front wheels 102 104 are generally circular in structure and in the preferred embodiment comprise a left wheel 102 attached to the left front part of the frame 100, and a right wheel 104 attached to the right front part of the frame 100. The front wheels 102 104 can be made of material such as metal or plastic and may be attached to the frame with hardware such as arms, pins, axles, or bearings. In the preferred embodiment, the front wheels can be powered by an electric motor whose control is integrated into the control switch 116.

The back wheels 106 108 are generally circular in structure and comprise a left wheel 106 attached to the left rear part of the frame 100, and a right wheel 108 attached to the right rear part of the frame 100. The back wheels 106 108 can be made of material such as metal or plastic and may be attached to the frame with hardware such as arms, pins, axles, or bearings. In one embodiment, the back wheels can be powered by an electric motor whose control is integrated into the control switch 116. In another embodiment, the back wheels 106 108 can be freely rotating.

The safety support wheels 120 122 are generally circular in structure and comprise a left wheel 120 attached to the left front part of the frame 100, and a right wheel 122 attached to the right front part of the frame 100. The safety support wheels 120 122 can be made of material such as metal or plastic and may be attached to the frame with hardware such as arms, pins, axles, or bearings.

As shown in FIG. 1 and FIG. 2, a preferred embodiment of the claimed wheelchair assembly comprises a seat assembly 118 attached to the central part of the frame 100. The seat assembly 118 can be made of material such as metal, plastic, or fabric. The seat assembly 118 may be adjustable at least vertically to better accommodate the occupant. In one embodiment, the seat assembly 118 may be adjusted with the assistance of an electric motor whose control is integrated into the control switch 116.

As shown in FIG. 1 and FIG. 2, a preferred embodiment of the claimed wheelchair assembly comprises an occupant support assembly having at least one chest support 140 and at least one leg support 130 132. The chest support 140 is attached to the frame 100. The chest support 140 has a curved shape opening upward to accommodate the occupant in the prone or kneeling prone position. The chest support 140 provides fixed support for the occupant's chest when in the prone or kneeling prone position. The chest support 140 can be made of material such as metal, plastic, or fabric. The chest support 140 may be adjustable at least vertically to better accommodate the occupant. In one embodiment, the chest support 140 may be adjusted with the assistance of an electric motor whose control is integrated into the control switch 116.

Still referring to FIG. 1 and FIG. 2, the leg support 130 132 generally has a curved plate to support the occupant's shin, and a foot stirrup to support the occupant's foot. The leg support 130 132 can have at least one leg support strap 134 136 to fix the occupant's leg into the leg support 130 132. The leg support 130 132 can be made of material such as metal or plastic. In a preferred embodiment, the leg support 130 132 can comprise a left leg support 130 and a right leg support 132.

As shown in FIG. 1 and FIG. 2, a preferred embodiment of the claimed wheelchair assembly comprises at least one armrest 112 114 attached to the frame 100. The armrest 112 114 is shaped as a general rectangular to run the length of the occupant's arm in the sitting or prone positions. The armrest 112 114 can be made of a material such as metal, plastic, or fabric. In one embodiment, the armrest 112 114 can comprise a left armrest 112 and a right armrest 114.

As shown in FIGS. 3-7, a preferred embodiment of the claimed wheelchair assembly comprises a rotating assembly having a front angled arm 182 186 and a rear angled arm 178 180. The front of the front angled arm 182 186 is connected to the frame 100. In one embodiment, the front of the front angled arm 182 186 is connected to an electric motor 200 by a rotating support such as a pin 168. The apex of the front angled atm 182 186 is connected to the frame by a rotating support such as a pin 162. The rear of the front angled arm is connected to the front of the rear angled arm 178 180 by a rotating support such as a pin 164. The front angled arm 182 186 can be made of material such as metal or plastic. In one embodiment, the front angled arm 182 186 can comprise a left front angled atm 186 and a right front angled arm 182.

The front of the rear angled arm 178 180 is connected to the front angled arm 182 186 by a rotating support such as a pin 162. The apex of the rear angled arm 178 180 is connected to the frame 100 by a rotating support such as a pin 160. The rear of the rear angled arm 178 180 is connected to the leg support 130 132. The rear angled arm 178 180 can be made of material such as metal of plastic. In one embodiment, a guide 190 is attached to the frame 100 and contains the rotating support 164 on a closed track. In one embodiment, the rear angled arm 178 180 can comprise a left rear angled arm 178 and a right rear angled arm 180.

Figure 3:
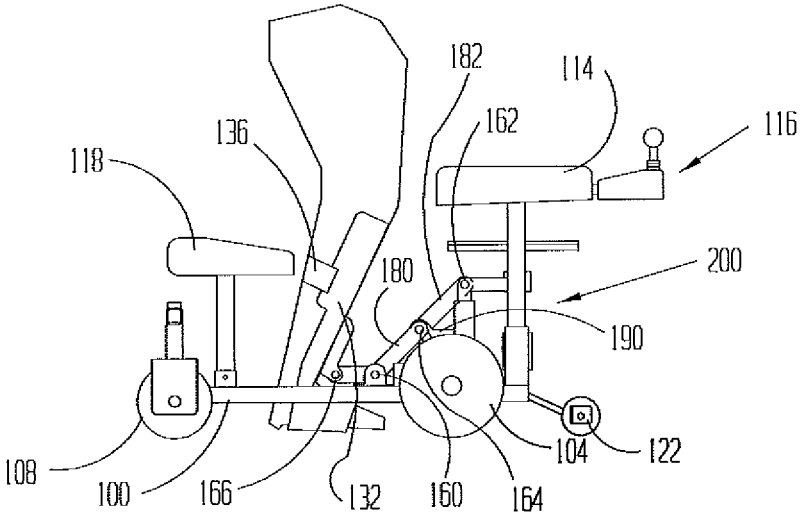
FIG. 3 is a side perspective of FIG. 1 with the occupant shown in the standing configuration.
Figure 5:
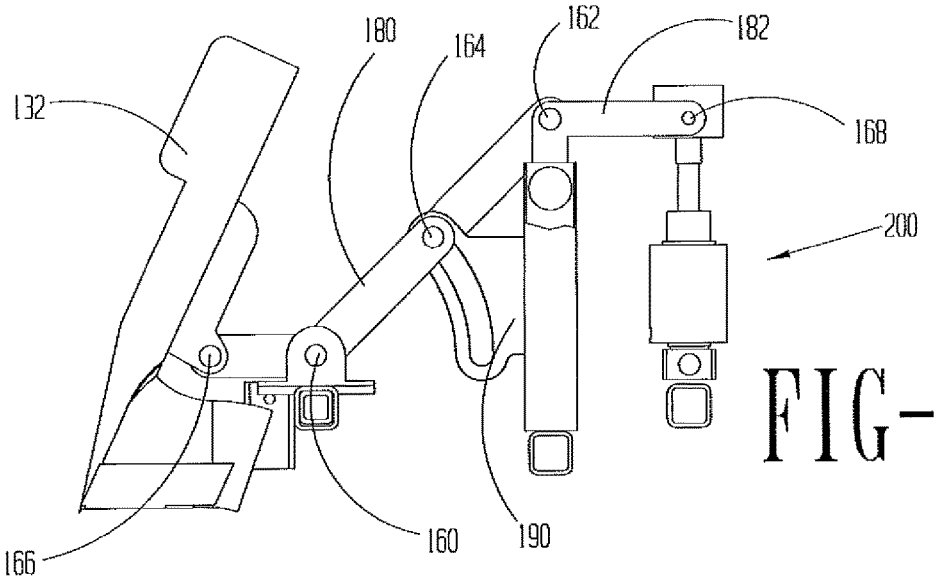
FIG. 5 shows one embodiment of the invention in which the leg support is generally perpendicular to the ground and the rotating assembly is assisted by an electric motor.

As shown in FIG. 1, FIG. 3, and FIG. 5, one configuration of the wheelchair assembly is with the leg support 130 132 in a generally vertical position and perpendicular to the ground. In this configuration, the occupant may be in at least a seated position or standing position. In the seated position, the occupant would be seated on the seat assembly 118 with the ability for the occupant's arms to rest on the armrest 112 114. In one embodiment, at least two of the wheels 102 104 106 108 attached to the frame 100 would be moved by an electric motor that would be controlled by the occupant through use of the control switch 116 attached to the armrest 112 114.

Figure 4:
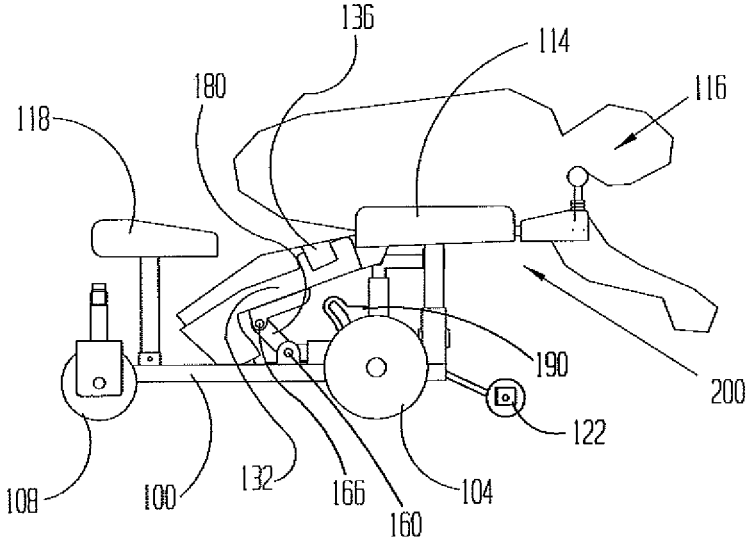
FIG. 4 is a side perspective of FIG. 2 with the occupant shown in the kneeling prone configuration.
Figure 6:
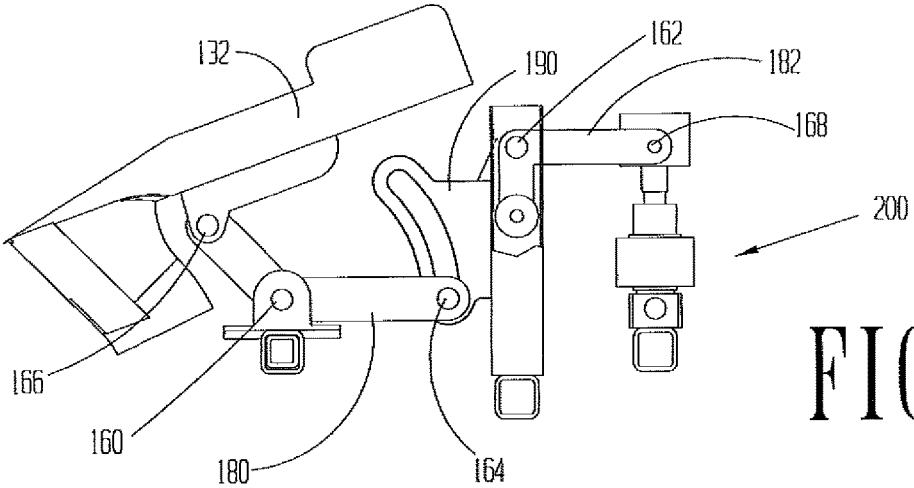
FIG. 6 shows one embodiment of the invention in which the leg support is generally parallel to the ground and the rotating assembly is assisted by an electric motor.
Figure 7:
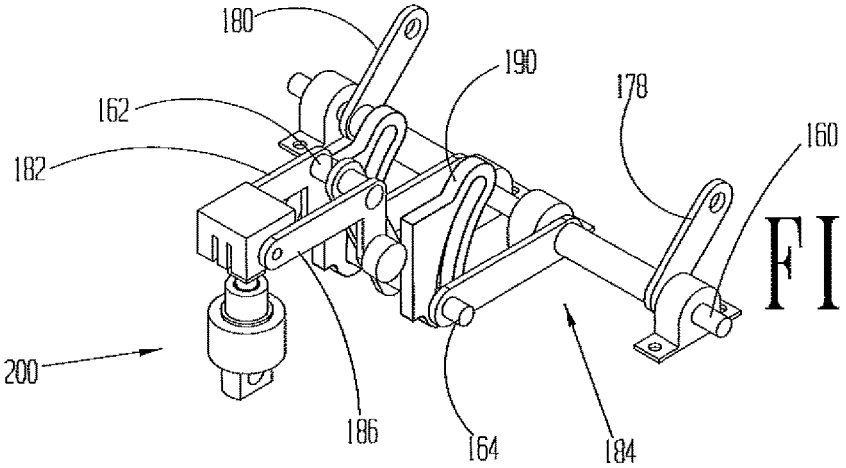
FIG. 7 is a perspective of one embodiment of the rotating assembly.

As shown in FIG. 2, FIG. 4, and FIG. 6, another configuration of the wheelchair assembly is with the leg support 130 132 in a generally horizontal position and parallel to the ground. In this configuration, the occupant would be in the prone or kneeling prone position. In the prone or kneeling prone position, the occupant's chest could rest on the chest support 140 with the ability for the occupant's arms to rest on the armrest 112 114. In one embodiment, at least two of the wheels 102 104 106 108 attached to the frame 100 would be moved by an electric motor that would be controlled by the occupant through use of the control switch 116 attached to the armrest 112 114.

Through support of at least one of the rotating assembly, leg support 130 132, leg support strap, 134 136, and armrest 112 114, the occupant is able to manipulate their position between the seated, standing, and kneeling prone positions.

In one embodiment, the rotating assembly has an electric motor 200 attached to assist the occupant in manipulating between at least the seated, standing, and kneeling prone positions. In one embodiment, the electric motor 200 is attached to the front of the front angled arm 182 and attached by a rotating support such as a pin 168. The electric motor 200 can be fixed to the frame and powered by an electric battery. The electric motor 200 can be a motor such as a hydraulic screw motor or other motor with the capability to move the rotating assembly. By moving the front of the front angled arm 182 vertically, the electric motor 200 can move the leg support 130 132 from generally perpendicular to the ground to generally horizontal to the ground, thereby assisting the occupant in manipulating their position between seated, standing, prone, and kneeling prone. In one embodiment, the electric motor 200 would be controlled by the occupant through use of the control switch 116 attached to the armrest 112 114. In a preferred embodiment, the armrest 112 114 may be attached to the rotating assembly and move vertically with the electric motor 200.

In a preferred embodiment, when the leg support 130 132 is generally perpendicular to the ground, the armrest 112 114 will be in the raised position (shown in FIG. 3). When the leg support 130 132 is generally parallel to the ground, the armrest 112 114 will be in the lowered position (see FIG. 4). The controlled raising and lowering of the armrest 112 114 by the electric motor assists the occupant in moving between the seated, standing, and kneeling prone positions.

The seat assembly 118, armrest 112 114, and chest support 140 can at least be adjusted vertically to provide better comfort and support to occupants of varying physical sizes and proportions. In one embodiment, these adjustments are made with the assistance of an electric motor. The leg support 130 132 and leg support strap 134 136 can be exchanged within the wheelchair assembly to provide better comfort and support to occupants of varying physical sizes and proportions.

Through use of at least one of the rotating assembly, leg support 130 132, leg support strap 134 136, armrest 112 114, chest support 140, and seat assembly 118, the occupant is able to manipulate their position with reduced shear and stress on the occupant, allowing them to be more mobile and active. In addition, by providing adjustable and customizable features within the wheelchair assembly, comfort can be increased and more occupants accommodated.

What is claimed is:

1. A mobile wheelchair assembly that enables an occupant to rotate their self from the seated position to the kneeling prone position so that the occupant may use their arms to better reach and grasp without the aid of another person, the wheelchair comprising:

a) a mobile base having a frame with front and rear ends;

b) a pair of front wheels connected to the front of the frame and a pair of back wheels connected to the back of the frame, wherein the front wheels, back wheels, or both are connected to and powered by a first electric motor, wherein control of said powered wheels is integrated into a control switch operated by the occupant;

c) a seat assembly connected to the back end of the frame, said seat assembly being capable of adjustment at least upward or downward with the assistance of a second electric motor, wherein control of said seat assembly is integrated into said control switch operated by the occupant;

d) a complete occupant support assembly including at least one leg support and at least one chest support and configurable between at least:

a first configuration in which the leg support is upright; and a second configuration in which the leg support is rotated forward toward the prone position;

wherein said complete occupant support assembly switches from one configuration to another with the assistance of a third electric motor, wherein control of said complete occupant support assembly is integrated into said control switch operated by the occupant;

e) at least one armrest alongside the seat and capable of adjustment at least upward or downward with the assistance of a fourth electric motor, wherein control of said armrest is integrated into said control switch operated by the occupant;

f) a rotating assembly having said third electric motor connected thereto for applying rotating force to the rotating assembly that can rotate the leg support between at least the first configuration and the second configuration wherein the occupant is rotated from the seated position into the kneeling prone position, wherein control of said rotating assembly is integrated into said control switch operated by the occupant;

wherein the occupant may navigate said wheelchair assembly to a desired location via said control switch and subsequently adjust said wheelchair assembly to facilitate the rotation of their self from the seated position to the kneeling prone position without the aid of another person.

2. The wheelchair of claim 1, wherein the armrest includes an upper portion against which an occupant's arm may rest during use of the wheelchair and which may provide additional support to occupant in use when rotating between at least the first configuration and the second configuration, wherein said control switch is attached to said armrest such that the occupant may operate said control switch.

3. The wheelchair of claim 1 wherein said wheelchair has a battery for supplying electrical energy to the electric motors.

4. The wheelchair of claim 1 wherein said control switch for operating said third electric motor operates said third electric motor to rotate said rotating assembly clockwise or counter-clockwise.

5. The wheelchair of claim 1 wherein the seat assembly, leg support, and armrest are configurable into a plurality of configurations including one or more of:

a first, seated upright configuration with the occupant seated upright in the seat assembly with the occupant's legs in the leg support upright and the occupant's arms laid flat against the armrest; and/or a second, kneeling prone position with the occupant free of the seat assembly and the occupant's legs in the leg support upright and the occupant's arms on the armrest laid flat against the armrest.

6. A wheelchair assembly that enables an occupant to rotate their self from the seated position to the kneeling prone position so that the occupant may use their arms to better reach and grasp without the aid of another person, the wheelchair comprising:

a) a mobile base having a frame with front and rear ends;

b) a pair of front wheels connected to the front of the frame and a pair of back wheels connected to the back of the frame, wherein the front wheels, back wheels, or both are connected to and powered by a first electric motor, wherein control of said powered wheels is integrated into a control switch operated by the occupant;

c) a seat assembly connected to the back end of the frame, said seat assembly being capable of adjustment upward or downward with the assistance of a second electric motor, wherein control of said seat assembly is integrated into said control switch operated by the occupant;

d) a complete occupant support assembly including at least one leg support and at least one chest support and configurable between at least:

a first configuration in which the leg support is upright; and a second configuration in which the leg support is rotated forward toward the prone position;

wherein said complete occupant support assembly switches from one configuration to another with the assistance of a third electric motor, wherein control of said complete occupant support assembly is integrated into said control switch operated by the occupant;

e) at least one armrest alongside the seat and capable of adjustment at least upward or downward with the assistance of a fourth electric motor, wherein control of said armrest is integrated into said control switch operated by the occupant;

f) a lifting assembly having said third electric motor connected thereto for applying force that can rotate the leg support between at least the first configuration and the second configuration wherein the occupant is rotated from the seated position into the kneeling prone position, wherein control of said rotating assembly is integrated into said control switch operated by the occupant;

wherein the occupant may navigate said wheelchair assembly to a desired location and subsequently adjust said wheelchair assembly to facilitate the rotation of their self from the seated position to the kneeling prone position without the aid of another person.

7. The wheelchair of claim 6, wherein the armrest is an armrest assembly which includes an upper portion against which an occupant's arm may rest during use of the wheelchair and which may provide additional support to occupant in use when rotating between the first configuration and the second configuration.

8. The wheelchair of claim 6 wherein said armrest assembly is anchored to the lifting assembly and moves vertically with said fourth electric motor.

9. The wheelchair of claim 6 wherein said wheelchair has a battery for supplying electrical energy to said electric motors.

10. The wheelchair of claim 6 wherein said control switch for operating said third electric motor operates said third electric motor to lift said lifting assembly clockwise or counter-clockwise.

11. The wheelchair of claim 6 wherein said lifting assembly comprises a motor lift mechanism attached to the leg supports, the armrest assembly, and the third electric motor.

12. The wheelchair of claim 11 wherein the motor lift mechanism comprises two angled arms connected with a pin, wherein the angled arms connect the leg supports to the third electric motor, and wherein the two angle arms comprise a front angled arm and a rear angled arm.

13. The wheelchair of claim 12 wherein said front angled arm is anchored with a moving pin between the third electric motor and leg supports, said front angled arm having a front end connected to the third electric motor at the front of the wheelchair and said front angled arm having a back end connected the rear angled arm.

14. The wheelchair of claim 12 wherein the rear angled arm is anchored with a moving pin between the third electric motor and leg supports, said rear angled arm having a front end connected to the front angled arm and said rear angled arm having a back end connected to the leg supports.

15. The wheelchair of claim 12 wherein said angled arms are connected within a guide.

16. The wheelchair of claim 12 wherein the third electric motor moves perpendicular to the chest support and seat.

17. The wheelchair of claim 12 wherein the third electric motor is a hydraulic screw motor.

* * * * *